United States Patent [19]

Sweet

[11] Patent Number: 4,626,222

[45] Date of Patent: Dec. 2, 1986

[54] TOY WEAPON PACK FOR FIGURE TOY

[75] Inventor: Roger H. Sweet, Long Beach, Calif.

[73] Assignee: Mattel, Inc., Hawthorne, Calif.

[21] Appl. No.: 781,297

[22] Filed: Sep. 27, 1985

[51] Int. Cl.[4] ..... A63H 3/00

[52] U.S. Cl. ..... 446/268; 446/473

[58] Field of Search ..... 446/268, 485, 473, 401, 446/405, 406, 23, 144, 491, 145, 433, 435, 98

[56] References Cited

U.S. PATENT DOCUMENTS

| | | | |
|---|---|---|---|
| 1,364,513 | 1/1921 | Ono | 446/433 |
| 2,674,923 | 4/1954 | Brandt . | |
| 2,741,872 | 4/1956 | Sigg . | |
| 3,010,718 | 11/1961 | Pearson, Jr. | 446/405 X |
| 3,267,810 | 8/1966 | Lancaster . | |
| 3,342,171 | 9/1967 | Ryan et al. . | |
| 3,397,484 | 8/1968 | Ryan et al. . | |
| 3,442,042 | 5/1969 | Gilbert . | |
| 3,594,947 | 7/1971 | Hartling et al. . | |
| 3,750,529 | 8/1973 | Reed et al. . | |
| 4,296,566 | 10/1981 | Campos . | |

FOREIGN PATENT DOCUMENTS

| | | | |
|---|---|---|---|
| 733045 | 7/1955 | United Kingdom | 446/406 |

*Primary Examiner*—Mickey Yu

*Attorney, Agent, or Firm*—Ronald Goldman; Melvin A. Klein; John G. Mesaros

[57] ABSTRACT

An accessory device simulating a portable weapon for use with a figure toy, the device having a housing with first and second barrel members alternatingly reciprocatingly mounted therein and driven by a spring motor for simulating the firing of a weapon, one barrel member including a simulated ejector portion extending through a slot in the side of the housing, and the other barrel member including a simulated firing mechanism portion extending through a slot in the rear of the housing. A pack assembly for attachment to the torso of the figure toy includes a stud for detachable connection to the weapon housing for attachment of the weapon thereto.

14 Claims, 13 Drawing Figures

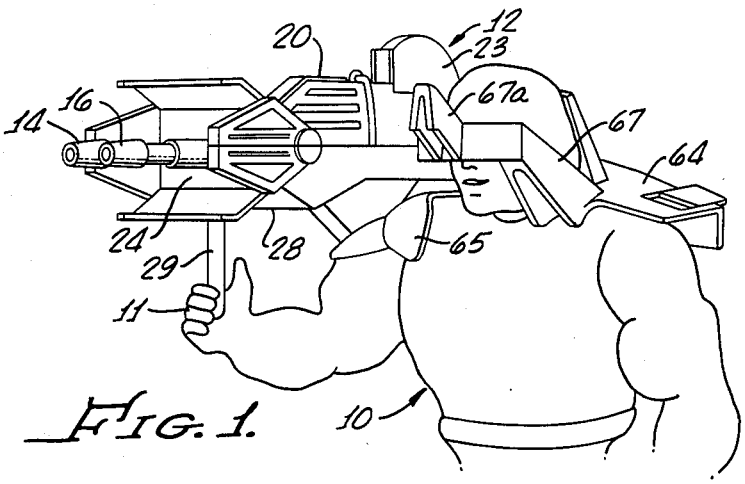
FIG. 1.
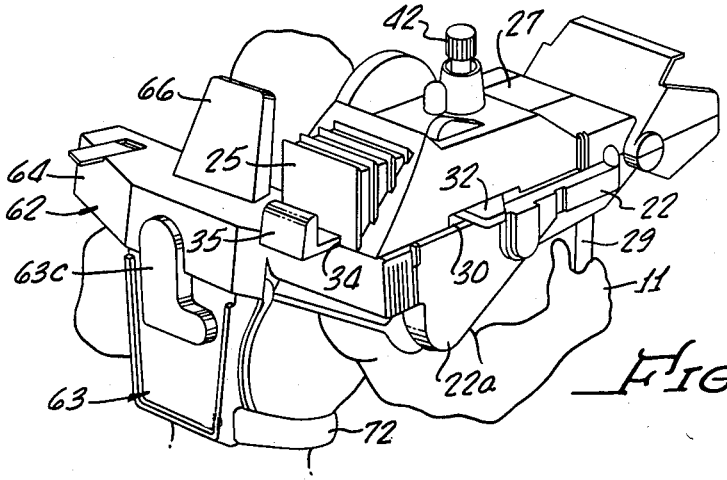
FIG. 2.
FIG. 3.
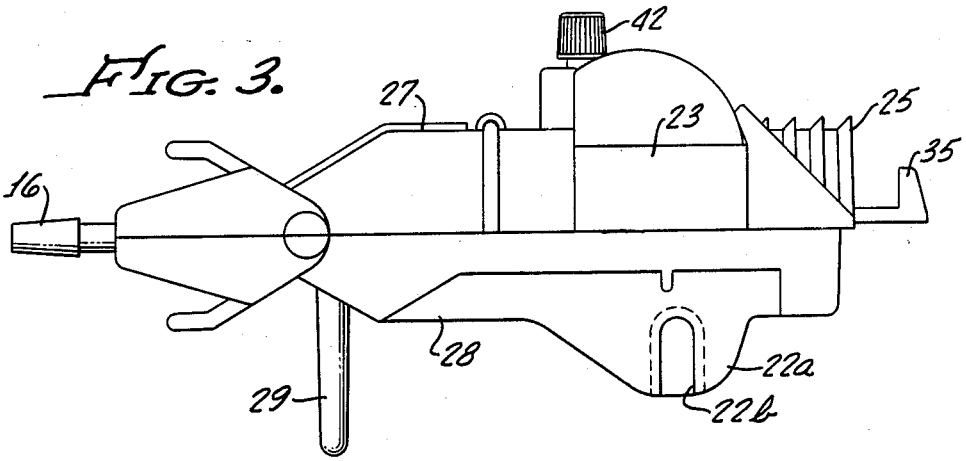

FIG. 4.
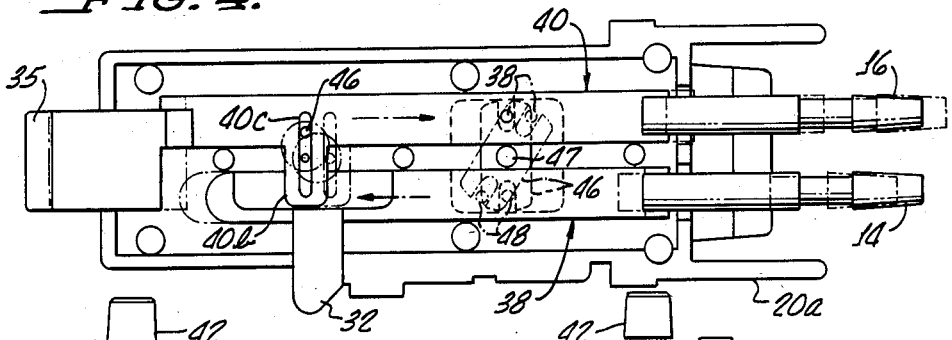
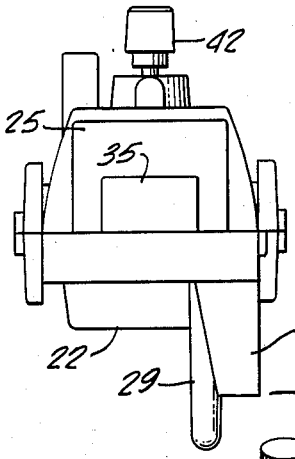
FIG. 6.
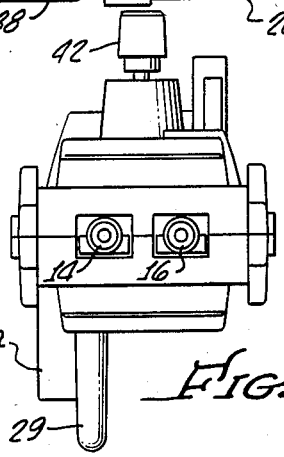
FIG. 5.
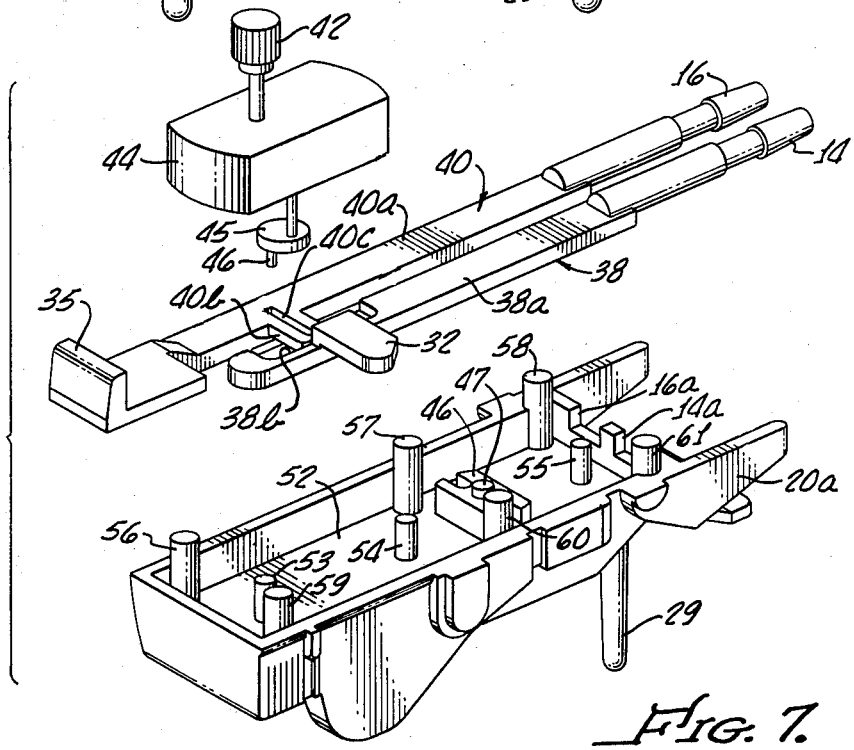
FIG. 7.

FIG. 8.
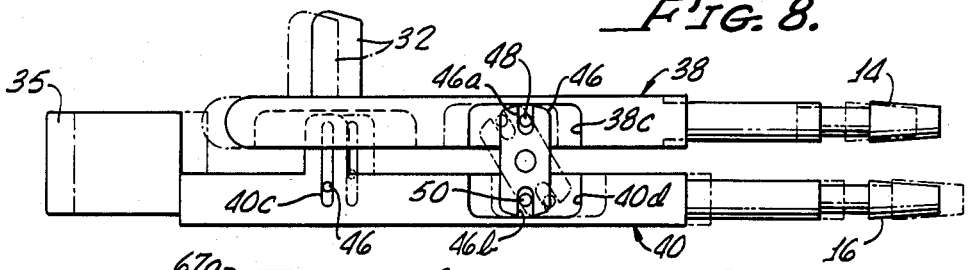
FIG. 9.
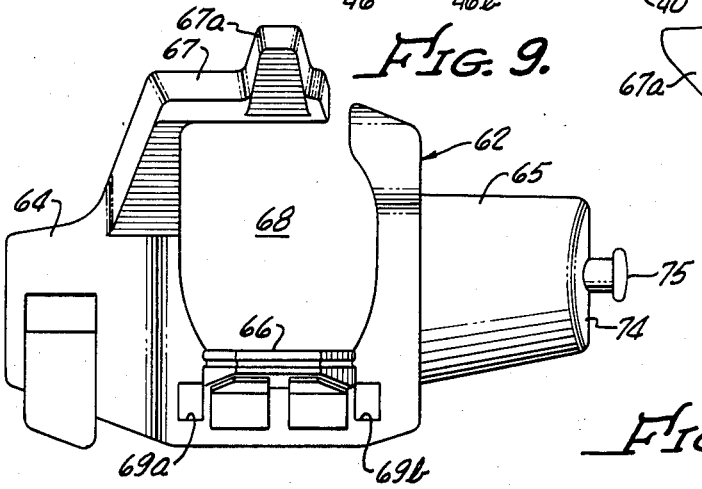
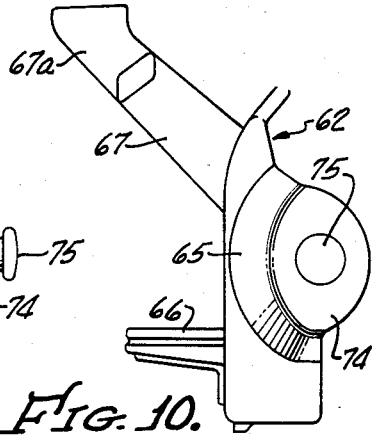
FIG. 10.
FIG. 11.
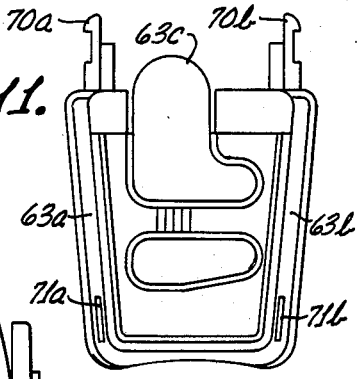
FIG. 13.
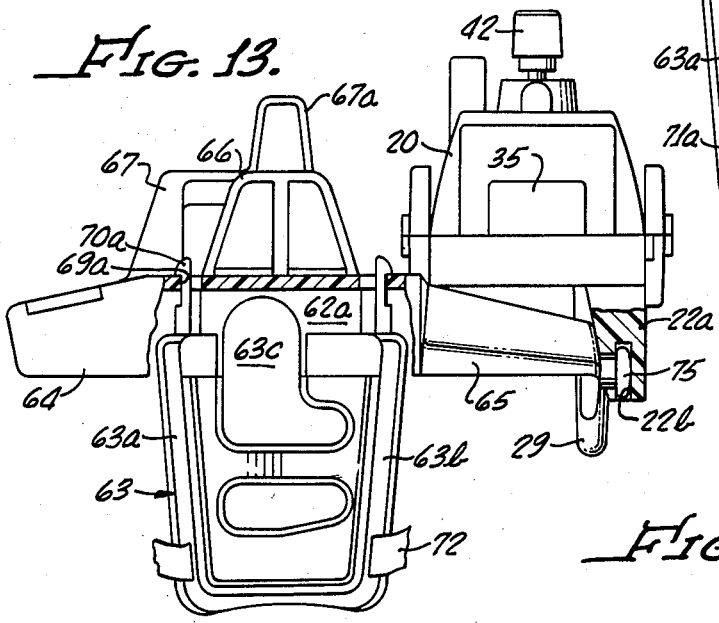
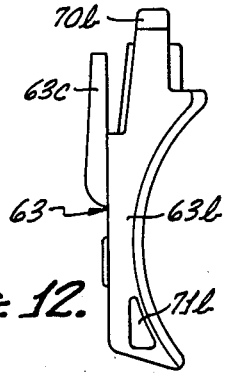
FIG. 12.

TOY WEAPON PACK FOR FIGURE TOY

BACKGROUND OF THE INVENTION

The background of the invention will be discussed in two parts:

Field of the Invention

This invention relates to animated figure toys, and more particularly to an accessory pack simulating a futuristic weapon for attachment to the upper torso of a figure toy.

Description of the Prior Art

Toy weapons, particularly toy weapons with sound emitting or action devices have been a source of amusement to children. Similarly, toy figures having posable or movable articulated limbs are very popular with children, with some such figures being referred to as action figures. Action figures usually have some distinguishing feature, such as being configured as the super hero type of figure, and usually such figures are provided with action accessories, such as vehicles, weapons and the like to enable the child to configure an action setting.

One such toy gun device is shown and described in U.S. Pat. No. 2,741,872, issued Apr. 17, 1956, to Sigg for a "Multiple Action Toy Gun", the toy including a barrel member operable between the force of two springs and actuated by a sawtooth cam member, which upon depression of the trigger, alternately engages the barrel member allowing oscillatory movement of the barrel as the trigger is moved.

Another toy weapon is shown and described in U.S. Pat. No. 3,342,171, entitled "Toy Pop Gun Having an Air Pump with a Resiliently Flexible Movable Chamber Closure Member", issued Sept. 19, 1967, to Ryan et al, the pop gun being in the form of a "bazooka".

Another such "bazooka" toy weapon is shown and described in U.S. Pat. No. 3,397,484, issued to Ryan et al on Aug. 20, 1968 for a "Sound and Optical Effects Toy".

A mechanical type toy with extendible legs or stilts is shown in U.S. Pat. No. 3,594,947, issued July 27, 1971, to Hartling et al for "Spacemen Carrier Toy".

Actual shoulder mounted portable rocket or missile launchers of the bazooka variety are shown and described in U.S. Pat. Nos. 2,674,923, issued Apr. 13, 1954 to Brandt for "Instruction Device"; 3,267,810, issued Aug. 23, 1966 to Lancaster for "Grenade Carrying Rocket"; and 3,750,529, issued Aug. 7, 1973 to Reed et al for "Multishot Portable Launching Apparatus".

Telescoping and pivotable gunstock devices for rifles are shown and described in U.S. Pat. No. 3,442,042, entitled "Rotatable and Slidable Gunstock", issued May 16, 1969, to Gilbert and U.S. Pat. No. 4,296,56, issued Oct. 27, 1981, to Campos, entitled "Arm or Shoulder Attachment for Gunstocks".

It is an object of the present invention to provide a new and improved accessory device for a figure toy.

It is another object of the present invention to provide a new and improved animated simulated weapon for use with a figure toy.

It is a further object of the present invention to provide a new and improved simulated shoulder carried weapon for use with a figure toy, the weapon having a pair of barrel members oscillating under force of a spring wound motor.

SUMMARY OF THE INVENTION

The foregoing and other objects are accomplished by providing an accessory pack for a figure toy, the pack having a housing configured to simulate a weapon, with first and second barrel members assembled in the housing for actuation by a spring motor which oscillates the two members alternately to simulate firing. One barrel member includes an integrally formed simulated ejector arm extending through a slot in the side of the housing and oscillating with the member. The other barrel member includes an integrally formed simulated firing mechanism extending from the rear of the housing and oscillating with the member. The weapon is assembled to the figure by a two part pack assembly which includes a simulated sight arm therein.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a front angle perspective view of the simulated weapon accesssory device for a figure toy according to the present invention;

FIG. 2 is a rear angle perspective view of the simulated weapon accesssory device for a figure toy according to the present invention;

FIG. 3 is a side elevational view of the weapon of the device of FIG. 1;

FIG. 4 is a top plan view of the weapon of FIG. 3 with the upper housing thereof removed;

FIG. 5 is a front view of the weapon of FIG. 3;

FIG. 6 is a rear view of the weapon of FIG. 3;

FIG. 7 is an exploded perspective view of the operative components of the weapon of FIG. 3;

FIG. 8 is an inverted view of the operative components shown in FIG. 3 without the housing;

FIG. 9 is a top plan view of the upper pack assembly of the accessory device of FIG. 1;

FIG. 10 is a side elevational view of the upper pack assembly of FIG. 9;

FIG. 11 is a rear elevational view of the lower pack assembly of the accessory device of FIG. 1;

FIG. 12 is a side elavational view of the lower pack assembly of FIG. 11; and FIG. 13 is a rear view of the upper pack assembly attached to the lower pack assembly, with portions thereof partially broken away, with the weapon of FIG. 3 mounted thereon with a portion broken away to show the attachment thereto.

DESCRIPTION OF THE PREFERRED EMBODIMENT

Referring now to the drawings, and particularly to FIGS. 1 and 2, there is shown a toy figure, generally designated 10, having an accessory weapon pack device, generally designated 12 assembled to the back and shoulder portions of the upper torso of the FIG. 10. The device 12 is configured in the form of a futuristic portable laser cannon having first and second barrel portions 14 and 16 extending out from the front of the gun housing 20.

The housing 20 is generally elongate and includes lower and upper housing portions 20*a* and 20*b*, which together have first and second sides 22, 23, first and second ends 24, 25, a top 27 and a bottom 28. A first slot 30 is formed in the side 22 thereof through which extends a simulated ejector 32, and a further slot 34 in the rear thereof through which extends a simulated firing device 35. A handle 29 depends from the bottom 28, the handle 29 being adapted and positioned for engagement with the hand 11 of the FIG. 10.

Referring also to FIGS. 3 through 8, the ejector 32 is integrally formed with a member 38 of which the barrel portion 14 is a part, and the firing device 35 is integrally formed with a member 40 of which the barrel portion 16 is a part. The members 38 and 40 are slidably mounted within the lower housing portion 20*a* for enabling alternating reciprocating movement of the barrel portions 14 and 16, along with the ejector portion 32 and the firing device portion 35, thus simulating a weapon firing.

An actuator knob 42 located on the top of the housing 20 is used to wind a spring motor 44, which drives a disc 45 having a radially offset cam pin 46 depending therefrom. The member 40 has a generally bar-shaped main body portion 40*a* with a transversely extending ear portion 40*b* having an elongated slot 40*c* formed therein, the slot 40*c* being in a direction generally perpendicular to the intended direction of reciprocation of the member 40. The slot is positioned and dimensioned for receiving therein the crank pin 46 of the disc 45 of the spring motor 44.

The member 38 has a generally bar-shaped main body portion 38*a* which, adjacent the end opposite the barrel portion 14, has a reduced thickness recessed surface 38*b* dimensioned for receiving the ear 40*b* in sliding relation thereon. By reference to FIGS. 3, 7 and 8, the undersurface of the two members 38 and 40 are provided with aligned reduced thickness recessed surfaces 38*c* and 40*d*, respectively, which are configured and dimensioned to coact with a rocker arm 46 pivotally mounted at the center thereof by an aperture therein engaging a pivot pin 47 in the lower housing portion 20*a*.

The opposite ends of the rocker arm 46 have first and second aligned slots 46*a* and 46*b* which coact with pins 48 and 50, respectively, the pins 48 and 50 being secured to the members 38 and 40, respectively, at about half the length of the recessed surfaces 38*c* and 40*d*, respectively. In this manner, by reference to FIG. 8, as the member 40 is driven in an oscillating direction by the crank pin 46 in engagement within the slot 40*c*, this force is exerted on one end of the rocker arm 46 by rocker pin 46*b*, which translates the movement in an equal and opposite direction to pin 46*a* and thus to member 38. As shown in dotted lines in FIG. 8, as the member 40 is driven to the right, the member 38 is driven to the left, and vice versa.

For assembly of the parts within the lower housing 20*a*, by referring to FIGS. 4 and 7, the inner surface of the housing 20*a* is provided with a generally planar surface 52 which has integrally formed therewith three upwardly extending aligned projections 53–55 on the longitudinal centerline thereof, these projections acting as guides intermediate the two members 38 and 40. On the outer edges of the housing portion 20*a* two pairs of aligned connection projections 56–58 and 59–61 are integrally formed therewith, these projections serving to interconnect the upper and lower housing portions 20*b* and 20*a*, with the two centermost opposite projections 57 and 60 also serving as outboard guides for restraining the movement of the members 38 and 40 in a longitudinal direction. The forward edge of the housing portion 20*a* has first and second slotted openings 14*a* and 16*a* formed therein for passage therethrough of the barrel portions 14 and 16 of members 38 and 40, respectively.

The housing 20 attaches to a mounting assembly, in the form of a back pack, formed of an upper shoulder engaging pack, generally designated 62, and a lower torso engaging pack, generally designated 63 (See FIGS. 1, 2 and 9–13), the two packs being configured for detented engagement. The upper pack 62 is formed in one piece, and has integrally formed therewith first and second laterally extending shoulder engaging portions 64 and 65, a head support portion 66 and a sighting arm portion 67, which is a generally L-shaped portion extending from the shoulder portion 64 and configured to position a simulated sight 67*a* in proximity to the eyes of the FIG. 10. As shown in FIG. 9, in plan elevation, the pack portion 62 is configured with an enlarged opening 68 for fitting over the head of the FIG. 10. The head support portion 66 extends upwardly relative to the opening 68 with a pair of elongated generally parallel slots 69*a* and 69*b* to the rear thereof, receiving, in detented angagement a pair of aligned detent tabs 70*a* and 70*b* formed integrally with the torso pack 63.

As shown in FIGS. 11 and 12, the lower pack 63 has a generally planar surface with inwardly extending arcuate side edges 63*a* and 63*b* contoured on the inner edge to conform to the back of the FIG. 10. The lower outer end of the edges 63*a* and 63*b* of the torso pack 63 are inwardly extending and include oppositely disposed slots 71*a* and 71*b* which receive therethrough a belt 72 configured for encircling the waist of the FIG. 10. The belt 72 may take any convenient form.

For additional structural support with the packs 62 and 63 interlocked, the torso pack 63 is provided with an integrally formed outwardly displaced upwardly extending pad portion 63*c* which abuts against the adjacent downwardly depending surface 62*a* of the upper pack 62 (See FIGS. 11–13).

The shoulder engaging portion 65 of upper pack 62 has a downwardly depending tab 74 at the end thereof with a mushroom-shaped stud 75 extending from the side thereof. The lower part of the side 22 of the housing 20 has a depending flange 22*a*, which on the interior thereof includes a slotted portion 22*b* configured for receiving therein the stud 75 for connection of the weapon housing 20 thereto (See FIGS. 3 and 13). The undersurface of the housing portion 20*a* is configured for generally abutting relation with the outer surface of the shoulder engaging portion 65 of the upper pack 62 with the stud 75 engaging the slot 22*b*.

After assembly, the operation of the weapon 12 is initiated by rotation of the knob 42 of the spring motor 44. During this winding, a thumb may be placed on the ejector 32 to prevent operation until released. After winding and release, the barrels 14 and 16 oscillate or reciprocate alternately, with corresponding movement of the ejector 32 and firing device 35, respectively, therewith, thus simulating the firing of a double barrel laser cannon. Although there are, per se, no sound emitting devices, the unwinding of the spring motor 44 along with the subtle clicking of the parts in movement, provides a slight whirring and clicking noise along with the barrel movement, consistent with a futuristic weapon, thus providing realism.

While there has been shown and described a preferred embodiment, it is to be understood that various other adaptations and modifications may be made within the spirit and scope of the invention.

I claim:

1. In an accessory device for use with a figure toy, the combination comprising:

a housing in the form of a simulated weapon;

first and second generally bar-shaped members slidably mounted within said housing, each of said members having a portion thereof extending through an opening in said housing to the exterior thereof with said portion configured to simulate the barrel of a weapon;

a motor means within the housing, said motor means including crank means;

means responsive to operation of said motor means for enabling alternating relative reciprocation between said members for simulating the firing of the weapon, said means responsive to operation of said motor means including crank coacting means on said first member for reciprocating said first member in response to operation of said motor means and rocker means within said housing for interconnecting said first and second members; and means for enabling attachment of said device to the upper torso of said figure toy.

2. The device according to claim 1 wherein said motor means is a spring wound motor.

3. The device according to claim 1 wherein said means for enabling attachment and said housing include matingly engaging means for detachably securing said housing to said means for enabling attachment.

4. The device according to claim 3 wherein said matingly engaging means includes a mushroom-shaped stud on said means for enabling attachment and a mating slot on a portion of said housing.

5. The device according to claim 4 wherein said means for enabling attachment includes shoulder engaging portions and a back engaging portion.

6. In an accessory device for use with a figure toy, the combination comprising:

a housing in the form of a simulated weapon, said housing having a first slot in the side thereof and a second slot therein;

first and second generally bar-shaped members slideably mounted within said housing, each of said members having a portion thereof extending through an opening in said housing to the exterior thereof with said portion configured to simulate the barrel of a weapon, said first bar-shaped member including a simulated ejector mechanism portion extending through said first slot, said second slot being in alignment with said second bar-shaped member, and said second bar-shaped member including a simulated firing pin mechanism extending through said second slot;

motor means within the housing; and means responsive to operation of said motor means for enabling alternating relative reciprocation between said members for simulating the firing of the weapon.

7. In an accessory device for use with a figure toy, the combination comprising:

a generally elongate housing for simulating a weapon, said housing having first and second sides, and first and second ends;

a first slot in said first side of said housing;

a second slot in said first end of said housing;

first and second apertures in said second end of said housing;

a first generally bar-shaped member slidably mounted within said housing and having a portion thereof extending out through said first slot for simulating a part of an ejector mechanism, and having a portion thereof configured to simulate the barrel of a weapon extending out through said first aperture;

a second generally bar-shaped member slidably mounted within said housing in generally parallel relation to said first member and having a portion thereof extending out through said second slot for simulating a part of a firing mechanism, and having a portion thereof configured to simulate the barrel of a weapon extending out through said second aperture;

motor means within the housing; and means responsive to operation of said motor means for enabling alternating relative reciprocation between said members for simulating the firing of the weapon.

8. The device according to claim 7 further including means for enabling attachment of said device to the upper torso of a figure toy.

9. The device according to claim 8 wherein said motor means includes crank means and means responsive to operation of said motor means includes crank coacting means on said first member for reciproctaing said first member in response to operation of said motor means.

10. The device according to claim 9 wherein said means responsive to operation of said motor means includes rocker means within said housing interconnecting said first and second members.

11. The device according to claim 10 wherein said motor means is a spring wound motor.

12. The device according to claim 7 wherein said device further includes pack means for attachment to the upper torso of the figure toy, said pack means and said housing including matingly engaging means for detachably securing said housing to said pack means.

13. The device according to claim 10 wherein said matingly engaging means includes a mushroom-shaped stud on said pack means and a mating slot on a portion of said housing.

14. The device according to claim 13 wherein said pack means includes a portion thereof configured and positioned for terminating adjacent the face of the figure toy, said portion simulating sighting means.

* * * * *